US009908022B1

(12) United States Patent
Bowe

(10) Patent No.: US 9,908,022 B1
(45) Date of Patent: Mar. 6, 2018

(54) COMBINATION COOLER AND PORTABLE TARGET TOSSING GAME

(71) Applicant: Indian Industries, Inc., Evansville, IN (US)

(72) Inventor: Graham R. Bowe, Yardley, PA (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 15/381,343

(22) Filed: Dec. 16, 2016

(51) Int. Cl.

| | |
|---|---|
| ***A63B 67/06*** | (2006.01) |
| ***F25D 31/00*** | (2006.01) |
| ***F25D 23/12*** | (2006.01) |
| ***F25D 3/06*** | (2006.01) |
| *F25D 3/08* | (2006.01) |

(52) U.S. Cl.
CPC ..... *A63B 67/06* (2013.01); *F25D 3/06* (2013.01); *F25D 23/12* (2013.01); *F25D 31/007* (2013.01); *F25D 3/08* (2013.01); *F25D 2201/126* (2013.01)

(58) Field of Classification Search
CPC ..... A63B 63/06; A63B 63/00; A63B 63/08; A63B 2210/50; F25D 3/08
USPC ..... 273/398–402; 62/457.5, 457.7
See application file for complete search history.

(56) References Cited

U.S. PATENT DOCUMENTS

| | | | | |
|---|---|---|---|---|
| 3,802,704 | A | 4/1974 | Genua | |
| 4,392,653 | A | 7/1983 | Blume, Sr. | |
| 4,936,590 | A * | 6/1990 | Palmer | A63B 63/08 273/285 |
| 4,982,966 | A | 1/1991 | Teafatiller | |
| 5,018,745 | A * | 5/1991 | Dunse | A63F 9/0208 273/338 |
| 5,067,727 | A | 11/1991 | Crompton | |
| 5,165,583 | A * | 11/1992 | Kouwenberg | A45C 11/20 206/428 |
| D341,381 | S | 11/1993 | Niebling | |
| D378,687 | S | 4/1997 | Clark et al. | |
| D388,127 | S | 12/1997 | Cavallone, Sr. | |
| 5,863,045 | A | 1/1999 | Watson et al. | |
| 5,882,010 | A | 3/1999 | Geror | |
| 6,669,200 | B1 | 12/2003 | Knetsch et al. | |
| 6,749,201 | B2 | 6/2004 | Kessler, Jr. et al. | |
| 6,899,336 | B2 | 5/2005 | Michelet et al. | |
| 7,134,662 | B2 | 11/2006 | Menendez | |
| 7,500,674 | B2 * | 3/2009 | Riley | A63B 67/06 273/126 R |
| 7,861,552 | B1 * | 1/2011 | Hughes | A45C 11/20 62/371 |
| 8,657,293 | B2 | 2/2014 | Sindaco | |

(Continued)

OTHER PUBLICATIONS

Go! Gater Washer Toss [online] [retrieved on Sep. 9, 2016] Retrieved from http://www.eastpointsports.com/product/16351f_washer_toss.

*Primary Examiner* — Mark Graham
(74) *Attorney, Agent, or Firm* — Woodard, Emhardt, Moriarty, McNett & Henry, LLP; Charles Meyer

(57) ABSTRACT

Certain embodiments of the disclosure combine an insulated cooler and toss game kit, such as a washer toss game. Two insulated halves form a pair of target portions when separated or can be combined to form a case. Game playing pieces, such as washers, and target cylinders are stored within the case. The two halves are configured to allow contents, such as beverages, food and/or temperature control materials to be stored in the interior volume.

19 Claims, 4 Drawing Sheets

(56) References Cited

U.S. PATENT DOCUMENTS

| | | | | |
|---|---|---|---|---|
| 8,764,017 | B2 * | 7/2014 | Manner | A63F 3/00533 273/398 |
| 9,358,439 | B2 | 6/2016 | Manner et al. | |
| 9,687,708 | B2 * | 6/2017 | Bennett | A63B 67/06 |
| 2001/0035613 | A1 | 11/2001 | Knetsch et al. | |
| 2004/0235388 | A1 | 11/2004 | Padilla | |
| 2005/0051968 | A1 | 3/2005 | Froesel | |
| 2006/0022409 | A1 | 2/2006 | Zimmermann | |
| 2006/0125186 | A1 * | 6/2006 | Digges, III | A63B 67/06 273/402 |
| 2007/0045964 | A1 * | 3/2007 | Petras | A63B 63/00 273/317 |
| 2009/0049860 | A1 | 2/2009 | Manner et al. | |
| 2009/0115136 | A1 * | 5/2009 | Voden | A63B 21/0053 273/336 |
| 2010/0025934 | A1 | 2/2010 | Hassman et al. | |
| 2010/0078441 | A1 * | 4/2010 | Barnett | A45C 13/36 220/592.2 |
| 2010/0275641 | A1 | 11/2010 | Manner et al. | |
| 2015/0069708 | A1 | 3/2015 | Mashburn | |

* cited by examiner

COMBINATION COOLER AND PORTABLE TARGET TOSSING GAME

FIELD OF THE INVENTION

The present disclosure relates to a portable target tossing game and kit for game play; and more particularly to a portable game kit in combination with an insulated cooler.

BACKGROUND

Recreational games are frequently played in backyards or at parks, beaches, tail-gating events or other outside areas. Tossing games such as horse shoes, bean bag toss or lawn darts are common. It is desirable that such games are easily portable and easy to setup and to store.

Separately, it is commonly desired to transport beverages, food or other items to a recreational event such as may occur in parks, beaches, tail-gating events or other outside areas. Often, it is desirable for the items to be temperature controlled, either kept cool or kept warm, to maintain a desired temperature or to lengthen the time period it takes to transition to an ambient temperature. One of the typical ways to keep contents temperature controlled is to use a cooler and/or a thermos with insulating properties. In many coolers the contents are stored and transported in individual serving sizes such as cans, bottles, juice boxes, cups, or comparable disposable and/or reusable food or beverage containers.

When travelling to a recreational event, if both a portable game and temperature controlled beverages and/or food are desired, it is often necessary to prepare and transport both the portable game playing equipment and an insulated cooler. Transporting both portable game equipment and a cooler requires sufficient transport space and carrying ability in both vehicle cargo space and when the items are manually carried. Transporting multiple items may be unwieldy and may require multiple trips and/or multiple people. Commonly, the owner takes the game playing equipment with them when the event is over. This requires that the game playing equipment is carried and transported again. Similarly, after an event a cooler must either be disposed of or also taken away by the owner for storage and reuse.

SUMMARY

Certain embodiments of the disclosure combine an insulated cooler and toss game kit. An example toss game is a washer toss game. In selected embodiments, the game kit includes two insulated halves which can form a pair of target portions when separated or which can be combined to form a case. Game playing pieces, such as washers, and target cylinders are stored within the case. The two halves are configured to allow contents, such as beverages, food or other items, to be stored in the interior volume. The halves are insulated for temperature control to help minimize increases in the temperature of the contents or alternately to minimize decreases in temperature. When desired, the halves can be selectively opened to allow access to the contents and/or to play the game.

Selected embodiments include a kit for playing a portable target tossing game comprising a case formed from two halves releasably securable in a closed configuration. Each half defines a game playing volume with a game playing floor. The playing volumes combine to form an interior storage volume in the closed configuration. Contents may be stored in the interior storage volume. A plurality of tos sable game playing pieces is stored in the case. The halves can be separated to expose the respective game playing volumes and game playing floors and the halves can be spaced apart in a game playing configuration. Each half is formed of a shell defining an enclosed hollow interior volume separated from the game playing volume. An insulating material fills the hollow interior volume of each shell and has thermal properties to assist in controlling the temperature of contents stored in the case.

Example embodiments include a kit for playing a portable target washer tossing game, comprising a case formed from two plastic halves configured to be releasably secured in a closed configuration. Each half defines a game playing volume with a game playing floor and sidewalls. The game playing volumes combine to form an interior storage volume in the closed configuration and contents may be stored in the interior storage volume. Each half comprises a target cylinder. A plurality of tossable washers is stored in the case. The halves can be separated to expose the respective game playing volumes and game playing floors and the halves can be spaced apart in a game playing configuration. Each half is formed of a shell defining an enclosed hollow interior volume separated from the game playing volume. A foam insulating material fills the interior volume of each shell. Optionally, a series of ring-shaped cavities is defined in the game playing floor of each half.

Still further embodiments comprise a case formed from two plastic halves configured to be releasably secured in a closed configuration; where each half defines a game playing volume with a game playing floor and sidewalls. The game playing volumes combine to form an interior storage volume of the case in the closed configuration. Contents may be stored in the interior storage volume. Each half comprises a target cylinder. A plurality of tossable washers is stored in the case in dedicated game storage locations separate from the interior storage volume. The halves can be separated to expose the respective game playing volumes and game playing floors and the halves can be spaced apart in a game playing configuration. Each half is formed with a shell defining an enclosed hollow interior volume separated from the game playing volume. A foam insulating material fills the interior volume of each shell. A series of cavities is defined in the game playing floor of each half. The cavities are arranged in aligned pairs between the halves; and, at least one beverage can having opposing ends is engaged with an aligned pair of cavities.

Further objects, features and advantages of the present invention shall become apparent from the detailed drawings and descriptions provided herein.

DESCRIPTION OF EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

Certain embodiments of the disclosure combine an insulated cooler and toss game kit. An example toss game is a washer toss game. In playing a standard washer toss game, game players toss washers from a selected distance, attempting to get the washers to land within or near the playing volume of a target portion and for extra points within a smaller target zone. In selected embodiments, the game kit includes two insulated halves which can form a pair of target portions when separated or which can be combined to form a case. Game playing pieces, such as washers, and target cylinders are stored within the case. The two halves are configured to allow contents, such as beverages, food and/or temperature control materials such as ice, cold packs or heat packs to be stored in the interior volume. The halves may be closed for storage and transport of the game kit and the contents. The halves are insulated for temperature control to help minimize increases in the temperature of the contents or alternately to minimize decreases in temperature. When desired, the halves can be selectively opened to allow access to the contents and/or to play the game.

Figure 1:
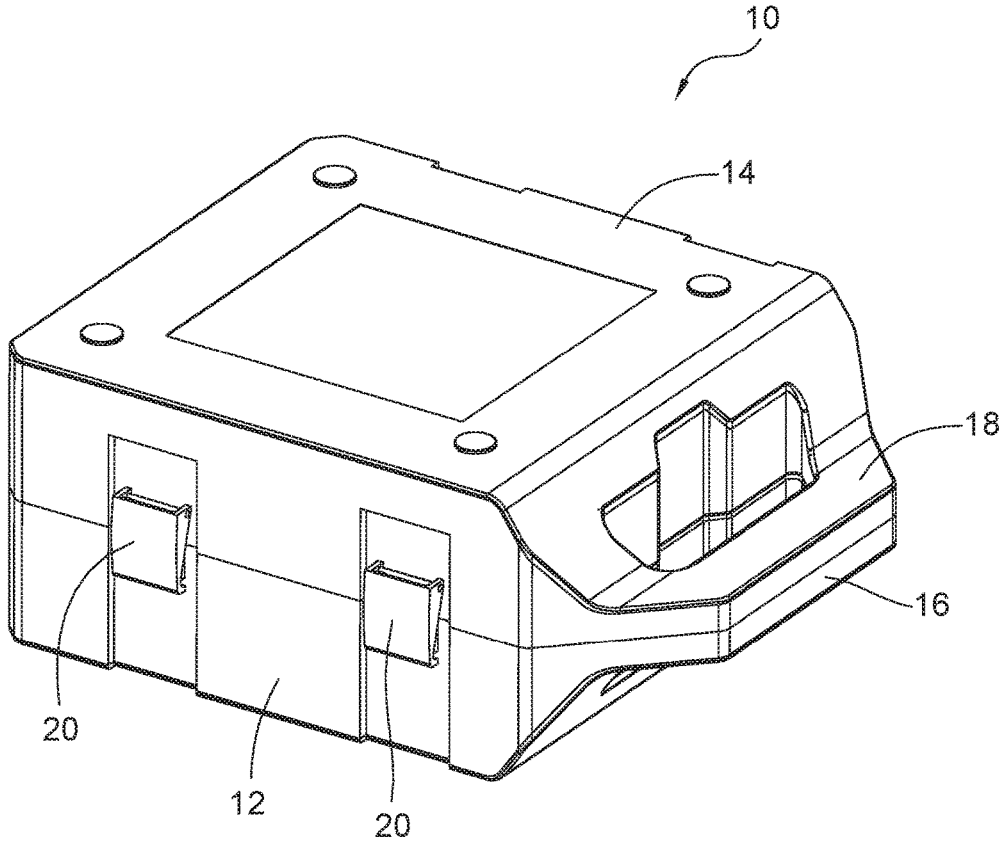
FIG. 1 is an illustration of an embodiment of the game kit in a closed configuration.

As illustrated in FIG. 1, a representative embodiment of game kit 10 includes a case formed of two insulated halves 12 and 14. For example, each half may be formed as a shell of blow molded plastic defining an enclosed hollow interior cavity. In certain embodiments the halves are formed of waterproof materials or have waterproof or water resistant surfaces, especially on the interior surfaces forming the target zone. The case may be embossed, labeled, and/or decorated with text, graphics, colors or color combinations to reflect selected information, artwork, themes or patterns or to correspond to a school's colors. The exterior surfaces may be smooth or textured as desired. Optionally, the exterior surfaces may incorporate bumpers or feet.

Figure 2:
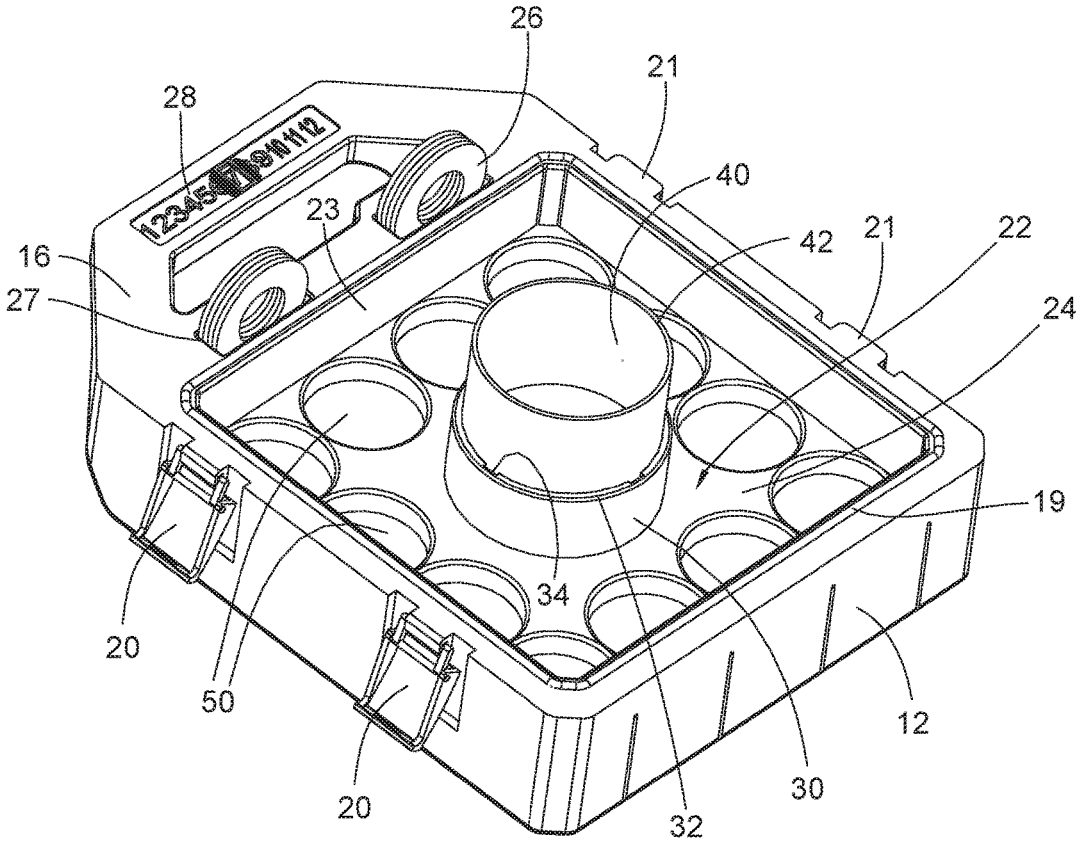
FIG. 2 is a perspective view of a game kit half in an open configuration.

With reference to FIGS. 1 and 2, each half defines a game playing volume 22 defining a target zone, which is interior to the case in the closed configuration. One or both of halves 12 and 14 may include handle portions 16, 18 which may be aligned to form a single handle when the case is closed. Halves 12 and 14 may include keyed aspects 19 which align and matingly engage, such as protruding ribs/flanges and slots, pegs and holes, or the like to assist in enabling a user to properly align the halves to close the case. The keyed aspects may also assist to maintain the halves in alignment in the closed configuration.

The halves 12 and 14 can be secured together in the closed configuration, for example using latches 20. The illustrated embodiment shows a pair of latches 20 on each half 12, 14 which are on opposing sides of game kit 10 in the closed configuration. Each latch 20 is aligned to engage a corresponding catch 21 on the opposing half to close the case. The latches 20 can be selectively engaged and disengaged by a user. As will be understood by those of skill in the art, in alternate embodiments, more or fewer latches in the same or different locations and/or different types of latches or fasteners can be used as desired, to allow the halves to be selectively aligned and secured together in the closed configuration. One example includes a disengagable hinge on one case side and a latch on the opposite case side. When unsecured, the halves can be separated and placed a selected distance apart for game play.

Figure 3:
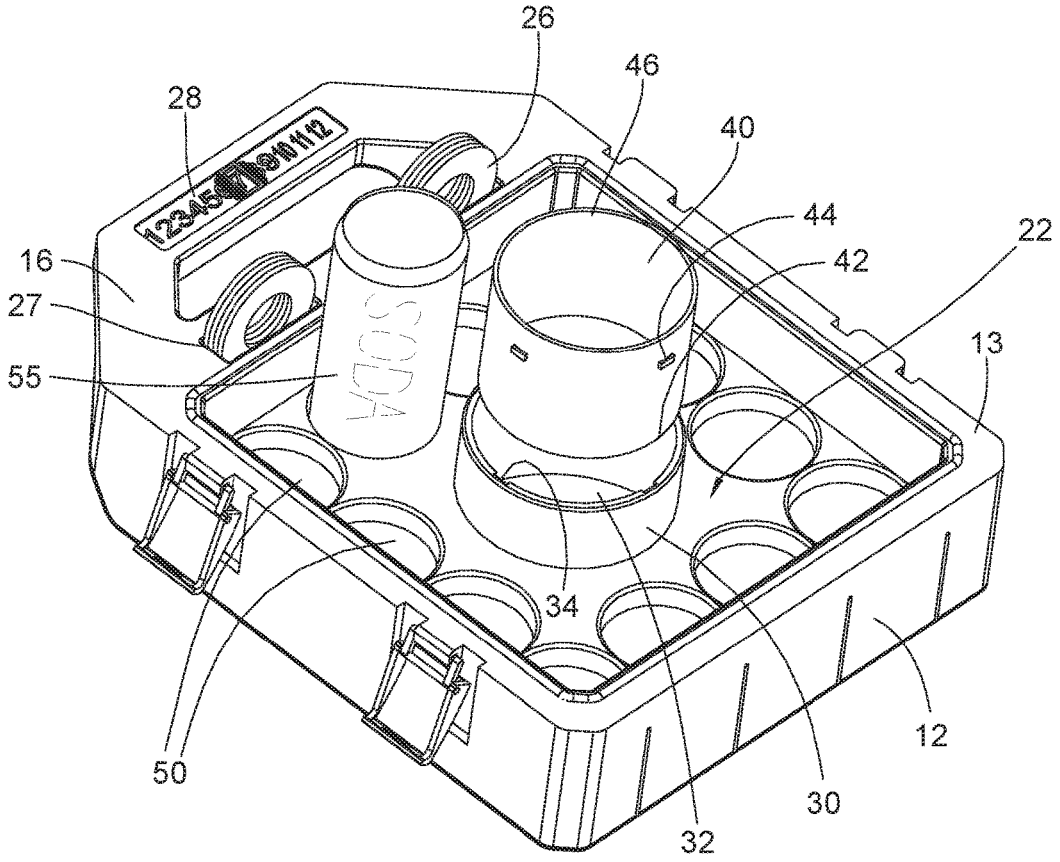
FIG. 3 is an illustration of the game kit half of FIG. 2 with the cylinder extension piece separated and reversed and an example beverage container.
Figure 4:
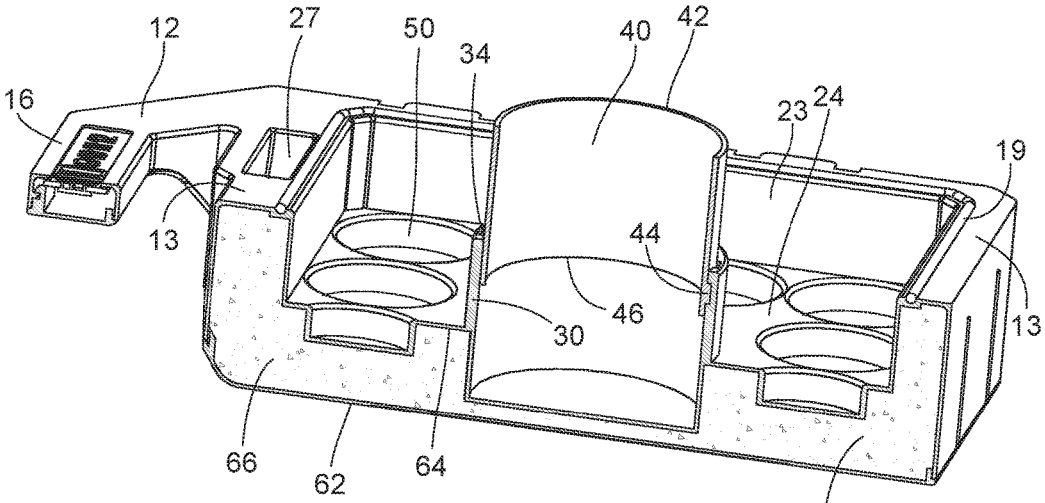
FIG. 4 is a cross-sectional view of the game kit half of FIG. 2.

A representative half 12 is illustrated in an open configuration in FIGS. 2-4. In certain embodiments, half 14 is the same as half 12. Halves 12 and 14 are arranged as mirror images with the game playing volumes facing each other in the closed configuration. When closed, the combined game playing volumes 22 define an interior storage volume. Half 14 is not separately discussed in detail for ease of illustration.

The playing side of each half defines a target zone including a game playing volume 22 defined by four sidewalls 23, and a floor 24. Half 12 has inner edges 13 at the tops of sidewalls 23 and around game playing volume 22. Optionally half 12 defines dedicated game piece storage locations such as washer storage slots 27 in which a plurality of game playing pieces such as washers 26 may be stored. In the illustrated embodiments, the washers 26 are stacked and received in symmetric slots 27 and the washers extend into matching slots in the two halves in the closed configuration. Alternately, a playing piece may be completely stored in one half without extending to the other half. In the illustrated embodiment, the washer slots 27 are adjacent to playing volume 22 and between a sidewall 23 and handle 16. As desired, a game piece storage location can be situated in the handle portion, in a sidewall 23 or in the floor 24 of game playing volume 22. When present, slots 27 help conveniently organize and store washers 26. Dedicated storage locations prevent the game playing pieces from moving and may separate the game playing pieces from mixing with any contents in the game playing volume. Still optionally, but less desirably, the playing pieces can be loosely stored in playing volume 22. Optionally, a score tally mechanism 28 may be incorporated into each half, for example a number line and sliding indicator can be located on the handle portion.

Washers 26 are typically cylindrical with an open center and made of metal to provide a desired weight. Washers 26 may be provided in two colors, such as blue and red, to differentiate between players or teams. Alternately, washers can be decorated in different color combinations or patterns, for example to reflect a school's colors or logo. Preferably an equal number of washers are provided for each player or team, with each team having a set of 2, 3, 4 or more washers. In alternate embodiments other washer materials may be used such as plastic or wood. In further embodiments, other types of tossable game playing pieces may be used such as bean bags, balls, horseshoes or flying discs.

In the illustrated embodiment, a target cylinder is located in the middle of the floor of game playing volume 22 as a smaller target zone or subzone. The target cylinder may provide a higher point zone. In certain embodiments, the target cylinder may be one piece integrated into the shell or alternately a piece which can be placed in position for game play. For example, the half may define a circular gutter into which a cylinder end fits with a friction fit. In the illustrated embodiment, the target cylinder is formed of two pieces which can be stacked to form a taller cylinder for play or which can be nested to form a lower height cylinder for storage. One piece is a cylinder base 30 formed integrally as part of the shell of half 12 and extending upward a selected height. Cylinder base 30 defines an upward opening 32 with an inner diameter. In the illustrated embodiment, the walls of cylinder base 30 define a series of slots 34.

The second piece is a cylindrical extension piece 40 configured to be received and supported by cylinder base 30. The outer diameter of extension piece 40 is sized to mate with and fit within the opening 32 of cylinder base 30. In the illustrated embodiment, the outer surface of extension piece 40 incorporates a series of radially outward extending tabs 44. Tabs 44 are arranged to be matched with and received within slots 34 when cylinder extension piece 40 is in place. Tabs 44 and slots 34 support cylinder extension piece 40 at a desired height relative to base 30 and inhibit rotation between the extension 40 and base 30. In the illustrated embodiment, four tabs and slots are equally spaced around the circumference of extension piece 40 and base 30. In alternate embodiments, different numbers of tabs such as 1, 2, 3 or more can be used and they can be spaced as desired. Optionally, there may be fewer tabs than slots. In further options, other arrangements such as a shelf or protruding lip, vertical tabs and slots, a threaded engagement or otherwise, can be used to designate the height and inhibit rotation of extension piece 40.

In certain embodiments, the height of extension piece 40 in the playing configuration is taller than the sidewalls 23 of playing volume 22. Alternately, the height of the cylinder and sidewalls may be approximately the same. This is accomplished and controlled by arranging tabs 44 at a desired distance from the playing end 42 of extension piece 40 so that the stacked height where the base 30 supports tabs 44 plus the distance from tabs 44 to the playing end 42 equals the desired playing height.

Figure 5:
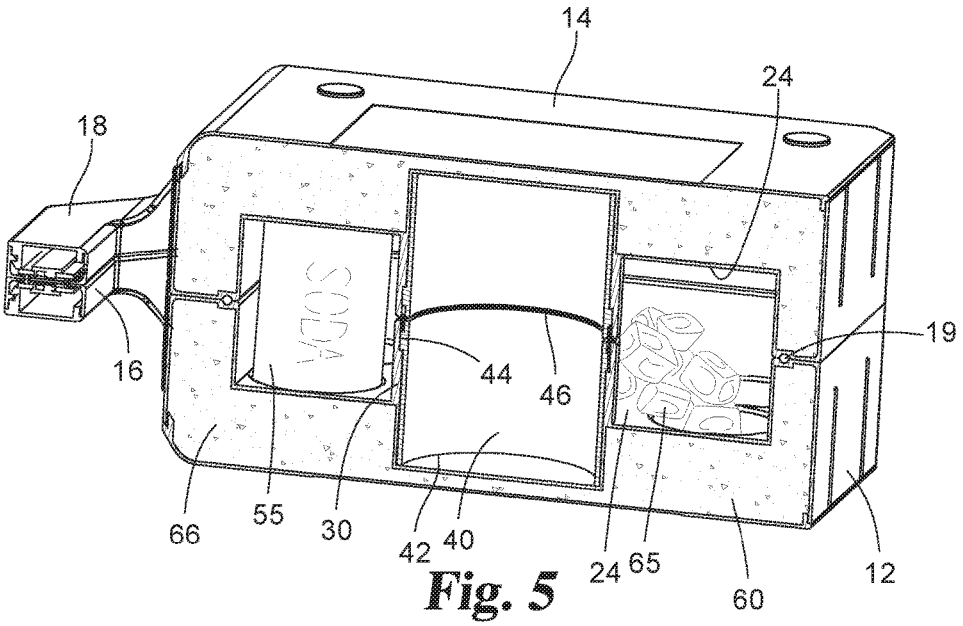
FIG. 5 is a cross-sectional view of the game kit and representative contents in a closed configuration.

In certain embodiments, tabs 44 are asymmetrically arranged along the height of extension piece 40. For example as visible in FIG. 3, the distance from tabs 44 to a storage end 46 may be less than the distance from tabs 44 to the playing end 42. Correspondingly, extension piece 40 may be configured to be reversibly received within base 30 in either a playing configuration or a storage configuration. FIG. 3 illustrates extension piece with playing end 42 turned downward for storage. Due to the asymmetric spacing of tabs 44, in the playing configuration the stacked height (FIG. 4) is taller than the stacked height in the storage configuration (FIG. 5). This allows extension piece 40 to be stored in base 30 with the stacked height equal to or less than the height of the sidewalls of playing volume 22, allowing the two halves to be closed without obstruction from the target cylinders.

The halves, washers and target cylinders of game kit 10 can be used for playing a tossing game, such as a washer toss game. Various sets of game playing rules can be used and varied as desired. In typical play, the halves are placed a fixed distance apart with their target zones facing upward. For instance the halves can be placed approximately 20-25 feet apart. The players then take their respective turns tossing the playing pieces towards the target zones. Scoring can depend on the rules, and may be based on a player tossing a game playing piece to land in the target zone, with higher or lower scores possible if the playing piece lands in the subzone or if the playing piece lands outside of but close to the target zone. The halves may be formed in various sizes, with a representative size being 16 in×16 in×4 in, with a representative target cylinder which is 4½ inches in diameter and 5 inches in height in the playing configuration.

In a further aspect, embodiments of the game kit 10 are insulated and configured to allow contents, such as beverages, food and/or temperature control materials, to be stored in the game playing volume 22. The insulated feature provides thermal properties which help maintain the temperature of the contents and lengthens the time in which the contents may increase/decrease, i.e. warm or cool, toward the ambient temperature.

As illustrated in cross-sectional views in FIGS. 4 and 5, the respective shells of halves 12, 14 each define an enclosed hollow interior volume 60. For example, the hollow interior volume 60 is arranged between an outer wall 62 which forms the exterior wall of the case and an inner wall 64. A face of inner wall 64 forms the interior game playing floor 24. In certain embodiments, the hollow interior volume 60 extends into the sidewalls 23 of each half, to surround five sides of game playing volume 22. Outer wall 62 and inner wall 64 extend upward to form the sidewalls 23 and are connected by edges 13 so that the hollow interior volume 60 is enclosed within the shell. The hollow interior volume 60 may be sealed and permanently closed during or after manufacturing or in certain embodiments may be selectively accessible, for example with a cover which can be opened and closed.

The interior volume 60 may be filled with an insulating material 66 having thermal properties to help control the temperature of contents in the storage volume. Insulating material 66 may be insulating foam with an open cell or closed cell structure. The foam may be injected and/or sprayed, preferably without undue expansion during placement. Examples of alternate insulating materials may be pieces of packing materials such as paper, shredded paper, cloth, Styrofoam® pieces, Styrofoam® peanuts or fiberglass. Foam, peanuts or other insulating arrangements may include air pockets or cells to enhance the insulation value while minimizing weight. The insulating material may be a dense material, but that is less desired.

In certain embodiments, the insulating material 66 is sealed within each half 12, 14. Alternately, each half may be configured to allow insulating packs, such as cold or heat packs to be inserted into the hollow interior volume prior to use. In further embodiments, the insulating material 66 may be a re-freezable or re-heatable composition such as a gel or liquid such as water or a propylene glycol mix. The composition can fill the cavity either loosely or in pre-filled packs. If a re-freezable or re-heatable composition is used, the game kit halves 12, 14 or packs may be cooled by the user in a freezer or heated as desired prior to use.

Aspects of game playing volume 22 may be configured to assist in storing and retaining the contents to be transported. In the embodiment illustrated in FIGS. 2-5, spaced around the target cylinder is a series of ring-shaped cavities 50 formed in floor 24. In one option, twelve cavities are illustrated. Other numbers of cavities can be included as desired. Cavities 50 are generally cylindrical with a sidewall and floor, extending from the floor 24 of game playing volume 22 into the thickness of half 12 or 14 and into the hollow interior volume 60. The ring shaped cavities 50 may not be visible from outside game kit 10. Insulating material 66 within the halves may abut the interior sides of ring-shaped cavities 50 so that the insulating material is only separated from the interior of the ring-shaped cavities by the thickness of inner wall 64. The insulating material 66 may be distributed along the inner wall 64 over and around the floors and the sidewalls of the ring-shaped cavities 50.

In certain example embodiments each cavity 50 is sized in diameter to nestably receive an end of a standard sized beverage can 55. As representative dimensions, a standard 12 fl. oz. can in the United States is 4.83 inches high, 2.13 inches in diameter at the lid, and 2.60 inches in diameter at the widest point of the body. Alternate dimensions to match other standard can sizes or custom sizes can be used as desired. Optionally, the wall-to-floor transition of cavities 50 may be tapered to match the lid or base taper on a beverage can end. In other embodiments, other cavity sizes and shapes may be used to correspond to and to retain other potential contents such as bottles, can or bottle openers, boxes, jars, food pouches or specifically shaped containers. Optionally in other embodiments the cavities can be located on the floor 24 or sidewalls 23.

Halves 12 and 14 define matching pairs of cavities 50 with the pairs aligned and facing each other when the halves are in the closed configuration. When closed, the interior height between the respective playing surfaces 24 plus the heights of an aligned pair of cavities 50, is sized to receive the height of a standard sized beverage can 55. As a representative example, the floors of a pair of aligned cavities may be separated by a height approximately equal to or slightly greater than 4.83 inches. In preparation for use, beverage cans 55 may be placed in respective cavities 50. Optionally, the spacing of the cans can be arranged to distribute the mass and correspondingly the weight and center of gravity of the case. When closed, the game kit halves engage the opposing ends of the cans and hold the cans in place. (FIG. 5) The cans are prevented from moving or significantly shifting position within the interior. Alternately, cans, bottles, boxes, bags, jars, or other types of containers or loose items can be placed and stored in the interior storage volume without being limited in position to the cavities. Optionally, a temperature control material 65 such as ice or a synthetic type of ice pack or heat pack can be placed within the interior storage volume and distributed around the stored contents.

In certain game playing variations, cavities 50 may be incorporated into game play. For example, different cavities may have different point values from each other or from other portions of the floor 24 of game playing volume 22. In another example, scoring may be different if a playing piece lands on floor 24 but not within a cavity 50. Optionally, cavities 50 can have different colors or labels for aesthetic purposes or to indicate different game aspects such as different point values.

While the disclosure has been illustrated and described in detail in the drawings and foregoing description, the same is to be considered as illustrative and not restrictive in character, it being understood that only certain preferred embodiments have been shown and described and that all changes and modifications that come within the spirit of the disclosure are desired to be protected.

What is claimed is:

1. A kit for playing a portable target tossing game, comprising:

a case formed from two halves releasably securable in a closed configuration;

each half defining a game playing volume with a game playing floor, wherein said game playing volumes combine to form an interior storage volume in the closed configuration and wherein contents may be stored in the interior storage volume;

a plurality of tossable game playing pieces stored in said case;

wherein said halves can be separated to expose the respective game playing volumes and game playing floors and the halves can be spaced apart in a game playing configuration;

wherein each half is formed with a shell defining an enclosed hollow interior volume separated from the game playing volume;

an insulating material filling the hollow interior volume of each shell, said insulating material having thermal properties to assist in controlling the temperature of contents stored in the case;

a series of ring-shaped cavities defined in the game playing floor of each half wherein said ring-shaped cavities are arranged in aligned pairs between the halves;

a beverage can having opposing ends in contact with and held by a pair of ring-shaped cavities; and, a temperature control material selected from the group consisting of ice, cold packs or heat packs placed within the interior storage volume in contact with said beverage can.

2. The kit of claim 1, wherein said halves are made of plastic.

3. The kit of claim 2, wherein said insulating material is insulating foam.

4. The kit of claim 3, wherein said hollow interior volumes are permanently sealed.

5. The kit of claim 1, comprising twelve pairs of ring-shaped cavities.

6. The kit of claim 1, wherein each half comprises a target cylinder.

7. The kit of claim 6, wherein each target cylinder comprises a base integrally formed with the half and a cylinder extension piece, wherein said base and said cylinder extension piece are configured to be stacked to form a taller cylinder for play or which can be nested to form a lower height cylinder for storage.

8. The kit of claim 7, wherein said cylinder extension piece is configured to engage said base using a tab and slot arrangement.

9. The kit of claim 8, wherein said cylinder extension piece comprises tabs asymmetrically located along the height of said cylinder extension piece.

10. The kit of claim 1, wherein said tossable game playing pieces are washers.

11. The kit of claim 1, wherein said two halves are releasably securable with latches.

12. The kit of claim 1, wherein said a plurality of tossable game playing pieces are stored in dedicated game storage locations defined in said case separate from said interior storage volume.

13. The kit of claim 1, wherein in the closed configuration the beverage can is held in place within the interior volume only by a pair of ring-shaped cavities.

14. The kit of claim 1, wherein in the closed configuration the height of the beverage can between the game playing floors is exposed to the interior volume.

15. A kit for playing a portable target tossing game, comprising:

a case formed from two plastic halves configured to be releasably secured in a closed configuration;

each half defining a game playing volume with a game playing floor and sidewalls, wherein said game playing volumes combine to form an interior storage volume of the case in the closed configuration and wherein contents may be stored in the interior storage volume;

wherein each half comprises a target cylinder, each target cylinder having a base secured to the half and a cylinder extension piece, wherein said base and said cylinder extension piece are configured to be stacked to form a taller cylinder for play or which can be nested to form a lower height cylinder for storage, wherein said cylinder extension piece is configured to engage said base using a tab and slot arrangement and wherein said cylinder extension piece includes tabs asymmetrically located along the height of said cylinder extension piece;

a plurality of tossable washers stored in said case;

wherein said halves can be separated to expose the respective game playing volumes and game playing floors and the halves can be spaced apart in a game playing configuration;

each half formed of a shell defining an enclosed hollow interior volume separated from the game playing volume;

a foam insulating material filling the interior volume of each shell; and, a series of ring-shaped cavities defined in the game playing floor of each half.

16. The kit of claim 15, wherein the base of each target cylinder is integrally formed with the half.

17. The kit of claim 16, comprising at least one 12 fl.oz. beverage can with a 2.60 inch diameter having opposing ends in contact with and held by said series of ring-shaped cavities and a temperature control material selected from the group consisting of ice, cold packs or heat packs placed within the interior storage volume in contact with said beverage can.

18. A kit for playing a portable target tossing game, comprising:

a case formed from two plastic halves configured to be releasably secured in a closed configuration;

each half defining a game playing volume with a game playing floor and sidewalls, wherein said game playing volumes combine to form an interior storage volume of the case in the closed configuration and wherein contents may be stored in the interior storage volume;

wherein each half comprises a target cylinder;

a plurality of tossable washers stored in said case in dedicated game storage locations separate from said interior storage volume;

wherein said halves can be separated to expose the respective game playing volumes and game playing floors and the halves can be spaced apart in a game playing configuration;

each half formed of a shell defining an enclosed hollow interior volume separated from the game playing volume;

a foam insulating material filling the interior volume of each shell;

a series of cavities defined in the game playing floor of each half, wherein said cavities are arranged in aligned pairs between the halves; and, at least one beverage can having opposing ends held by an aligned pair of cavities, and, a temperature control material selected from the group consisting of ice, cold packs or heat packs placed within the interior storage volume in contact with said beverage can.

19. The kit of claim 18, wherein each target cylinder comprises a base integrally formed with the half and a cylinder extension piece, wherein said base and said cylinder extension piece are configured to be stacked to form a taller cylinder for play or can be nested to form a lower height cylinder for storage and wherein the cylinder extension piece comprises tabs asymmetrically located along the height of the cylinder extension piece.

* * * * *